US007482989B2

(12) United States Patent
Nakagawa et al.

(10) Patent No.: US 7,482,989 B2
(45) Date of Patent: Jan. 27, 2009

(54) EASILY MAINTAINABLE ON-VEHICLE ELECTRONIC DEVICE

(75) Inventors: Masashi Nakagawa, Fukushima-ken (JP); Tadaaki Onishi, Niigata-ken (JP)

(73) Assignees: Alps Electric Co., Ltd., Tokyo (JP); Nippon Sheet Glass Co., Ltd., Tokyo (JP)

( * ) Notice: Subject to any disclaimer, the term of this patent is extended or adjusted under 35 U.S.C. 154(b) by 0 days.

(21) Appl. No.: 11/707,485

(22) Filed: Feb. 15, 2007

(65) Prior Publication Data

US 2007/0188393 A1 Aug. 16, 2007

(30) Foreign Application Priority Data

Feb. 16, 2006 (JP) ..... 2006-039458

(51) Int. Cl.
*H01Q 1/32* (2006.01)

(52) U.S. Cl. ..... 343/713; 343/711

(58) Field of Classification Search ..... 343/713, 343/711, 712

See application file for complete search history.

(56) References Cited

U.S. PATENT DOCUMENTS 6,937,197 B2 * 8/2005 Wiedmann et al. ..... 343/713

2005/0285806 A1 * 12/2005 Ikeda et al. ..... 343/713

FOREIGN PATENT DOCUMENTS

JP 2005-327329 11/2005

* cited by examiner

*Primary Examiner*—Tho G Phan
(74) *Attorney, Agent, or Firm*—Beyer Law Group LLP

(57) ABSTRACT

An on-vehicle electronic device (1) is for amplifying an external signal received by an antenna radiating conductor (21) patterned on a glass surface (20) of a vehicle window, and for sending the amplified signal to a receiver circuit. The on-vehicle electronic device (1) mainly includes an attachment base (2) including terminal members (9) and (10), a circuit board (3) provided with an antenna circuit including a preamplifier circuit, attachment screws (4) and (5) for attachably and detachably fixing the circuit board (3) to the attachment base (2), a shield case (6) for covering the preamplifier circuit, and a radome (7) for covering the entire device. The terminal members (9) and (10) are solder-joined to feed portions (21*a*) and (21*b*) of the antenna radiating conductor (21). The lower surface of the circuit board (3) is provided with a feeding electrode (11) and an earth electrode (12), which are pressure-contacted with the terminal members (9) and (10), respectively, through fastening of the attachment screws (4) and (5).

6 Claims, 4 Drawing Sheets

EASILY MAINTAINABLE ON-VEHICLE ELECTRONIC DEVICE

BACKGROUND OF THE INVENTION

1. Field of the Invention

The present invention relates to an on-vehicle electronic device including an antenna circuit such as a preamplifier circuit and interposed between an antenna radiating conductor provided on a glass surface of a vehicle window and an external circuit such as a receiver circuit, and particularly to an on-vehicle electronic device used attached to the glass surface.

2. Description of the Related Art

Conventionally, there has been widely known a method of providing a glass surface of a vehicle window (e.g., a rear window) with a relatively long antenna radiating conductor such as a diversity antenna. Such an antenna device using the vehicle window as the installation space therefor is expected to be increasingly generalized along with the spread of terrestrial digital broadcasting.

As for the signal wave of the terrestrial digital broadcasting or the like, a signal received by the antenna radiating conductor needs to be promptly amplified so that the attenuation of the received signal is suppressed as much as possible to thereby obtain good reception sensitivity. In the antenna device including the antenna radiating conductor disposed on the glass surface of the vehicle window, therefore, an electronic device including therein a circuit board provided with a preamplifier circuit is usually attached to the same glass surface in the vicinity of the antenna radiating conductor so that the signal wave is sent to an external circuit such as a receiver circuit via the preamplifier circuit (see Pages 2 and 3 and FIG. 1 of Japanese Unexamined Patent Application Publication No. 5-327329, for example). That is, in the conventional electronic device of this type, the circuit board included therein is electrically connected to a pair of feed portions of the antenna radiating conductor via a lead wire or the like, and is fixed to the glass surface of the vehicle window via attachment leg pieces or the like. The connection of the electronic device to the antenna radiating conductor or the glass surface is generally made by soldering.

As in the above-described conventional technique, the electronic device, which includes therein the circuit board provided with the preamplifier circuit or the like and is attached to the glass surface of the vehicle window in the vicinity of the antenna radiating conductor, is connected to the antenna radiating conductor or the glass surface by soldering or the like to thereby secure required attachment strength. However, the electronic device has such an attachment structure that makes it extremely difficult to detach and reattach the circuit board with respect to the glass surface. Therefore, maintenance such as adjustment, repair, or component replacement of the antenna circuit including the preamplifier circuit cannot be easily performed.

SUMMARY OF THE INVENTION

The present invention has been made in view of the above-described circumference of the conventional technique, and an object of the present invention is to provide an easily maintainable on-vehicle electronic device, in which a circuit board can be attached and detached without difficulty with respect to a glass surface of a vehicle window.

To achieve the above object, an on-vehicle electronic device according to the present invention includes a circuit board, an attachment base, and a plurality of attachment screws. The circuit board includes an antenna circuit, and a feeding electrode and an earth electrode drawn from the antenna circuit. The attachment base includes a pair of terminal members held by an insulative member, and is fixed to a glass surface of a vehicle window. The plurality of attachment screws attachably and detachably fix the circuit board to the attachment base. The circuit board is fixed to the attachment base, with the pair of the terminal members connected to a pair of feed portions of an antenna radiating conductor fixedly provided to the glass surface, and with the feeding electrode pressure-contacted with one of the two terminal members and the earth electrode pressure-contacted with the other one of the two terminal members.

According to the on-vehicle electronic device, in which the circuit board is thus made attachable and detachable by the attachment screws with respect to the attachment base fixed to the glass surface of the vehicle window, the feeding electrode and the earth electrode of the circuit board can be pressure-contacted with the terminal members of the attachment base through the fastening of the attachment screws. Thus, the antenna circuit provided on the circuit board and the feed portions of the antenna radiating conductor are electrically connected to each other via the terminal members. Further, the circuit board can be easily detached from the attachment base by releasing the fastening of the attachment screws, while required attachment strength can be secured by fastening the attachment screws when attaching the circuit board again to the attachment base. Therefore, maintenance such as adjustment, repair, or component replacement of the antenna circuit can be easily performed. Further, soldering or the like can be employed to connect the terminal members to the feed portions of the antenna radiating conductor. Accordingly, there is no possibility of insufficient attachment strength of the electronic device with respect to the glass surface of the vehicle window.

In the above-described configuration, the circuit board may be formed with the feeding electrode and the earth electrode on a surface thereof, and may include a pair of through holes, which face the vicinities of the feeding electrode and the earth electrode, respectively, and through which the attachment screws are inserted. Further, each of the terminal members may include a board mounting portion pressure-contacted with either one of the feeding electrode and the earth electrode and formed with a screw hole into which the corresponding attachment screw is screwed. Thus configured, an attachment structure can be adopted without difficulty in which, even if the attachment screws are inserted through the through holes and screwed deep into the screw holes of the board mounting portions after portions of the circuit board in the vicinities of the through holes have been mounted on the board mounting portions of the terminal members, the leading ends of the attachment screws will not reach the glass surface. Therefore, this configuration is preferable in that it is easy to perform an attachment operation of making the circuit board pressure-contacted with and fixed to the terminal members by using the attachment screws, and to increase the attachment strength of the circuit board with respect to the terminal members. In this case, each of the terminal members may be formed by a metal plate, which is bent between the board mounting portion and a fixed portion connected to the corresponding feed portion, and a part of the metal plate may be buried in the insulative member through insert molding. This configuration is preferable in that the attachment base can be easily and highly accurately manufactured.

Further, in the above-described configuration, the antenna circuit provided on the circuit board may include a preamplifier circuit. This configuration is preferable in that a signal received by the antenna radiating conductor can be promptly amplified, and thus that the attenuation of the received signal can be suppressed. In this case, a shield case may be provided which is formed by a metal plate and attached to the circuit board to cover the preamplifier circuit. Further, one end of a coaxial cable held by the shield case may be connected to a wiring pattern of the circuit board to establish conduction between the preamplifier circuit and an external circuit. This configuration is preferable in that the shield case can protect the preamplifier circuit by electromagnetically shielding the circuit against an external wave, and thus that noise of the received signal can be reduced. In addition, a radome may be provided which is formed of a synthetic resin and attached to the attachment base to cover the circuit board and the shield case. This configuration is preferable in that the water resistance and dust resistance performance and the designability can be improved by the radome.

In the on-vehicle electronic device according to the present invention, the circuit board can be attached and detached by the attachment screws with respect to the attachment base fixed to the glass surface of the vehicle window. Further, the circuit board can be easily detached from the attachment base by releasing the fastening of the attachment screws, while required attachment strength can be secured by fastening the attachment screws when attaching the circuit board again to the attachment base. Accordingly, maintenance such as adjustment, repair, or component replacement of the antenna circuit can be easily performed.

DESCRIPTION OF THE PREFERRED EMBODIMENTS

An embodiment of the present invention will now be described with reference to the drawings.

Figure 1:
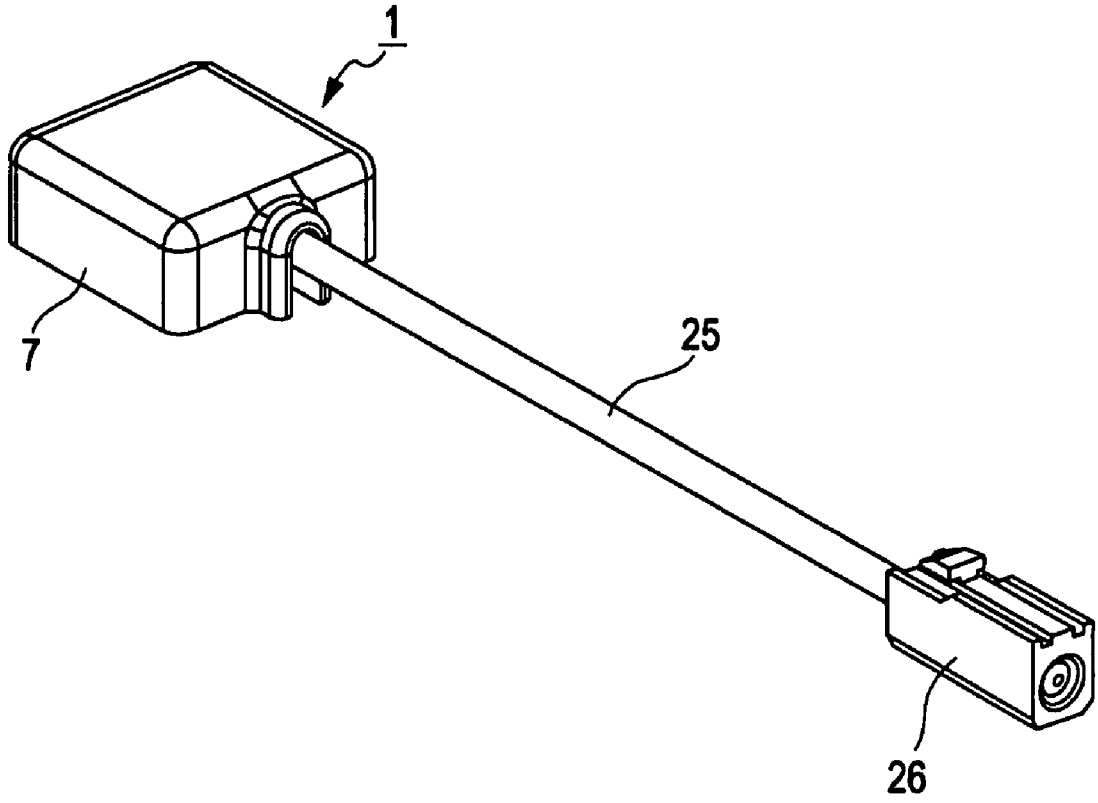
FIG. 1 is an external view of an on-vehicle electronic device according to an embodiment of the present invention.
Figure 2:
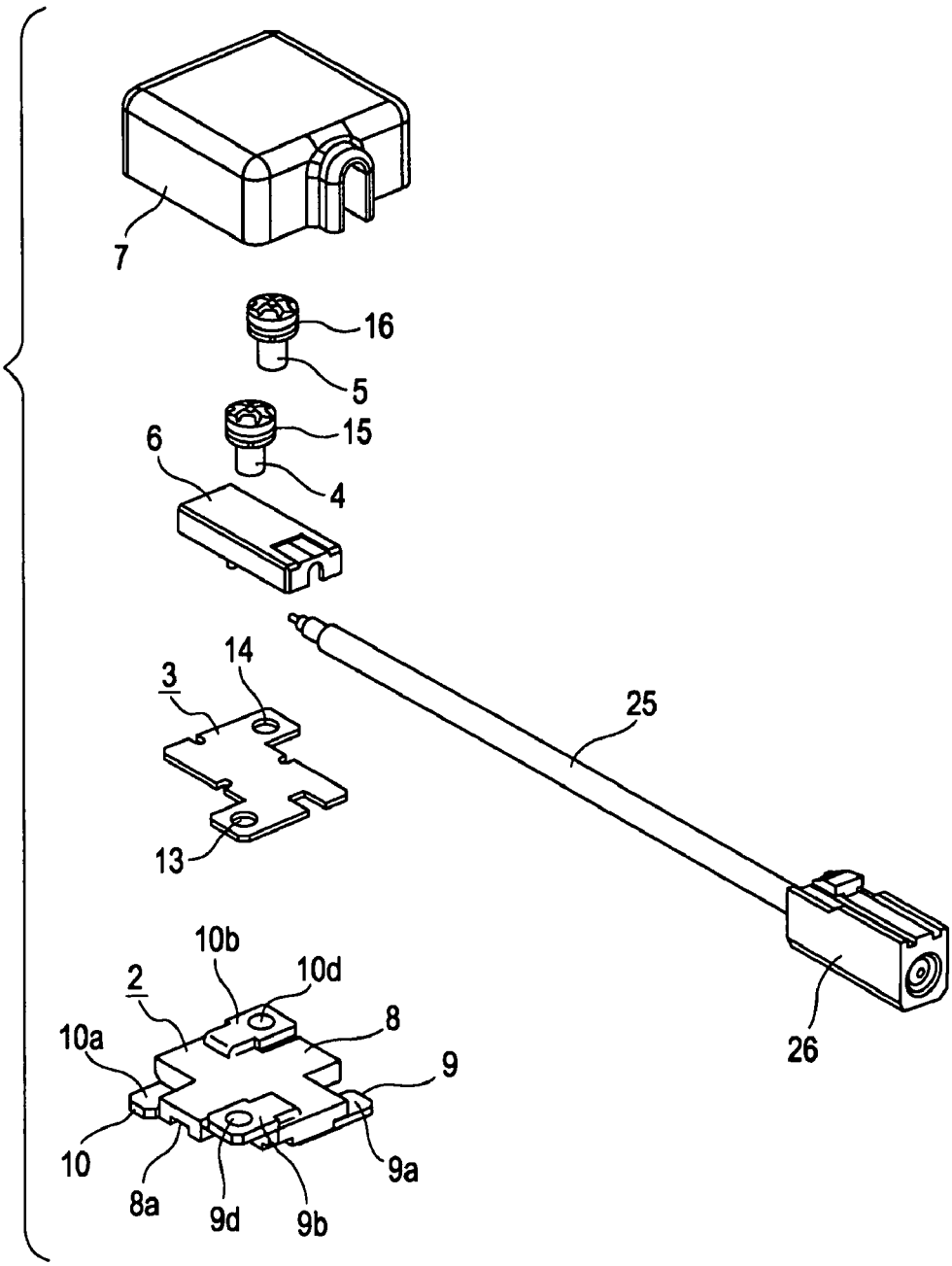
FIG. 2 is an exploded perspective view of the on-vehicle electronic device.
Figure 3:
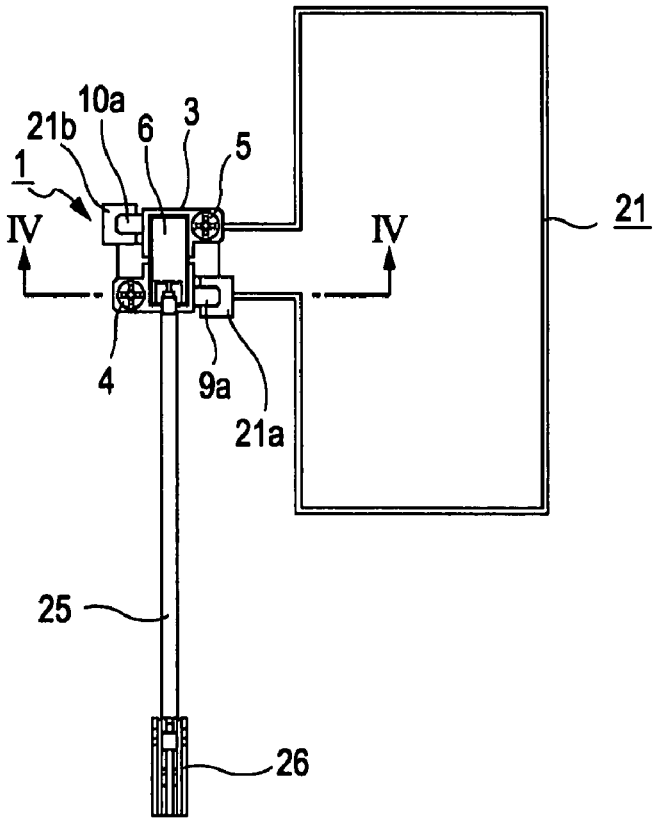
FIG. 3 is a plan view illustrating a connection structure of the on-vehicle electronic device and an antenna radiating conductor.

An on-vehicle electronic device 1 illustrated in the drawings is for amplifying an external signal received by an antenna radiating conductor 21, which is fixedly provided to a glass surface 20 (see FIG. 4) of a vehicle window, and for sending the amplified signal to a receiver circuit (not illustrated), and is used attached to the glass surface 20. As illustrated in FIG. 2, the on-vehicle electronic device 1 mainly includes an attachment base 2, a circuit board (an LNA (low noise amplifier) board) 3, attachment screws 4 and 5, a shield case 6, and a radome 7. Further, a wiring pattern of an antenna circuit (not illustrated) provided on the circuit board 3 is connected to one end (i.e., an input end) of a coaxial cable 25 held by the shield case 6, and the other end (i.e., an output end) of the coaxial cable 25 is attached with a coaxial connector 26. The antenna radiating conductor 21 is a loop antenna patterned on the glass surface 20, and the opposite ends of the loop form feed portions 21*a* and 21*b*.

Figure 4:
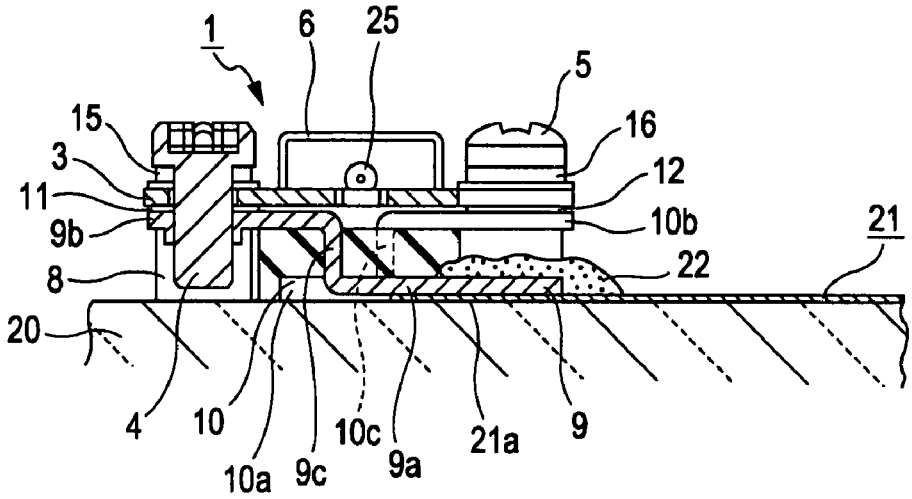
FIG. 4 is a cross-sectional view along the IV-IV line shown in FIG. 3.

The configuration of the on-vehicle electronic device 1 will now be described in detail. The attachment base 2 is formed by integrating an insulative member 8 with conductive terminal members 9 and 10 through insert molding. The insulative member 8 is molded into a substantially cross shape in a plan view. With the center of the insulative member 8 as a base, a pair of the terminal members 9 and 10 are disposed to be substantially point-symmetrical to each other. As illustrated in FIG. 4, the terminal member 9 is a metal plate bent by press processing, and includes a flat fixed portion 9*a* solder-joined (the reference numeral 22 denotes a solder) to the feed portion 21*a* of the antenna radiating conductor 21, a flat board mounting portion 9*b* extending at a position apart from the glass surface 20 and pressure-contacted with a feeding electrode 11 of the circuit board 3, and a standing portion 9*c* which is an intermediate portion connecting the fixed portion 9*a* to the board mounting portion 9*b* and buried in the insulative member 8. The board mounting portion 9*b* is formed with a screw hole 9*d* into which the attachment screw 4 is screwed. The terminal member 10 is a metal plate bent into the same shape as the shape of the terminal member 9, and includes a flat fixed portion 10*a* solder-joined to the feed portion 21*b* of the antenna radiating conductor 21, a flat board mounting portion 10*b* extending at a position apart from the glass surface 20 and pressure-contacted with an earth electrode 12 of the circuit board 3, and a standing portion 10*c* which is an intermediate portion connecting the fixed portion 10*a* to the board mounting portion 10*b* and buried in the insulative member 8. The board mounting portion 10*b* is formed with a screw hole 10*d* into which the attachment screw 5 is screwed. Since the terminal members 9 and 10 are integrated with the insulative member 8 through insert molding, the attachment base 2 can be easily and highly accurately manufactured.

The upper surface of the circuit board 3 is provided with the antenna circuit (not illustrated) including a preamplifier circuit, and the lower surface of the circuit board 3 is formed with the feeding electrode 11 and the earth electrode 12 drawn from the antenna circuit. That is, the antenna circuit on the upper surface and the respective electrodes 11 and 12 on the lower surface are connected to each other via wall conductors of through holes 13 and 14 formed in two corners of the circuit board 3. The peripheries of the through holes 13 and 14 on the lower surface are the regions in which the feeding electrode 11 and the earth electrode 12 are respectively formed. The circuit board 3 is mounted on the attachment base 2, with the through holes 13 and 14 positioned directly on the screw holes 9*d* and 10*d*, respectively. With leading end portions of the attachment screws 4 and 5 inserted through the through holes 13 and 14 and screwed into the screw holes 9*d* and 10*d*, the circuit board 3 is nipped and fixed between washers 15 and 16 of the attachment screws 4 and 5 and the board mounting portions 9*b* and 10*b* of the terminal members 9 and 10. That is, the circuit board 3 is fixed to the attachment base 2 through the fastening of the attachment screws 4 and 5, with the feeding electrode 11 and the earth electrode 12 pressure-contacted with the board mounting portions 9*b* and 10*b*, respectively. If the fastening of the attachment screws 4 and 5 with respect to the terminal members 9 and 10 is released, the circuit board 3 can be detached from the attachment base 2.

Figure 5:
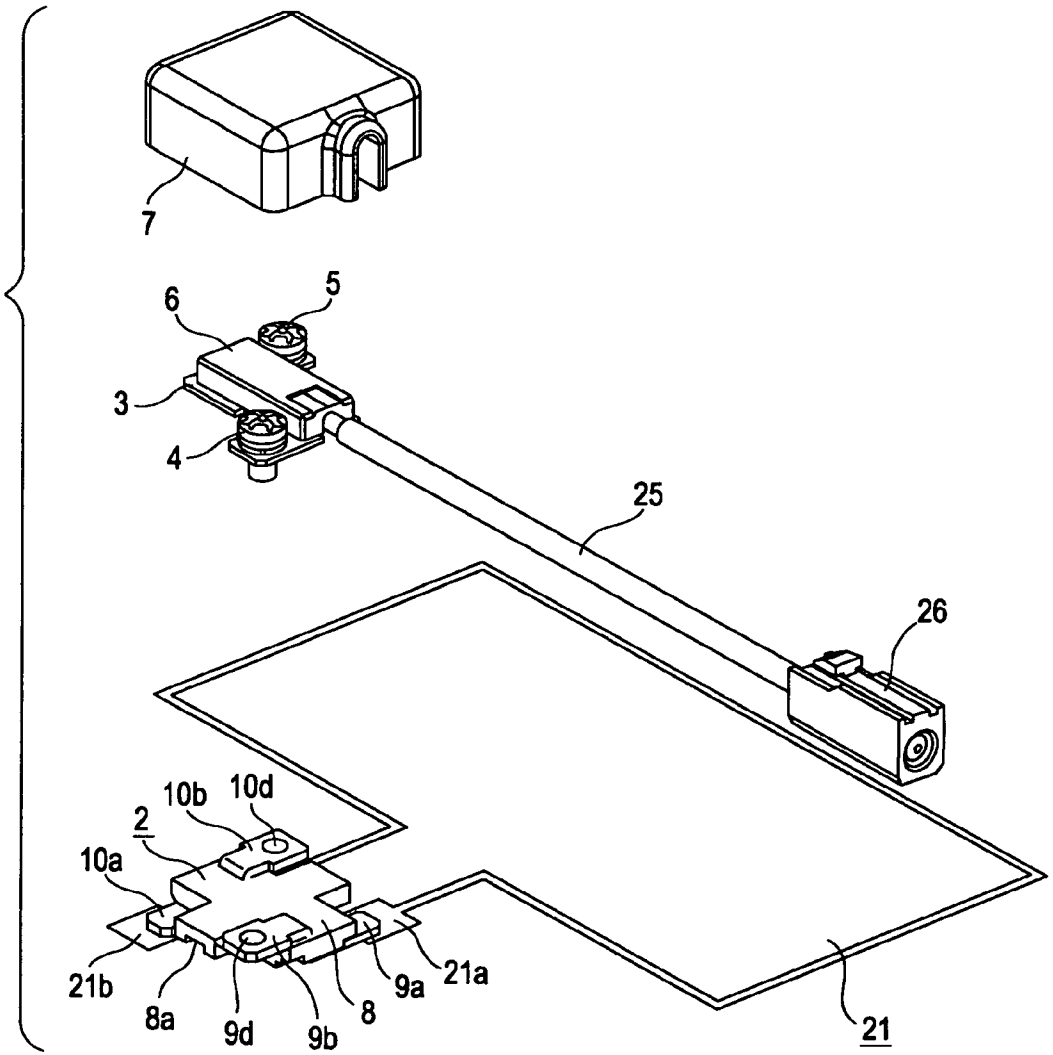
FIG. 5 is an exploded perspective view corresponding to FIG. 3.

As illustrated in FIG. 5, the shield case 6 includes a box-shaped member formed by a metal plate, and is attached to the circuit board 3 to cover the preamplifier circuit. The shield case 6 is for protecting the preamplifier circuit by electromagnetically shielding the circuit against an external wave. Thereby, noise of the received signal can be reduced. Meanwhile, the radome 7 is a chassis formed of a synthetic resin, and snap hooks (not illustrated) provided at a lower portion thereof are snapped in locking grooves 8*a* of the insulative member 8. The radome 7 is attached to the attachment base 2 to cover the circuit board 3, the shield case 6, the attachment screws 4 and 5, and the like. The water resistance and dust resistance performance and the designability can be improved by the radome 7.

In the thus configured on-vehicle electronic device 1, the terminal members 9 and 10 are solder-joined to the feed portions 21*a* and 21*b* of the antenna radiating conductor 21. Thus, the attachment base 2 is firmly fixed to the glass surface 20 of the vehicle window. Further, the feeding electrode 11 and the earth electrode 12 of the circuit board 3, which are screwed into and fixed to the attachment base 2, are pressure-contacted with the terminal members 9 and 10. Thus, the external signal received by the antenna radiating conductor 21 patterned on the glass surface 20 is promptly sent from the feed portions 21*a* and 21*b* to the antenna circuit of the circuit board 3 to be subjected to amplification processing, and the amplified signal is sent to the external receiver circuit via the coaxial cable 25. Accordingly, it is possible to suppress the attenuation of the received signal, and thus to perform effective regeneration of the signal.

As described above, in the on-vehicle electronic device 1 according to the present embodiment, the circuit board 3 can be attached and detached by the attachment screws 4 and 5 with respect to the attachment base 2 fixed to the glass surface 20 of the vehicle window. Further, the feeding electrode 11 and the earth electrode 12 can be pressure-contacted with the terminal members 9 and 10 through the fastening of the attachment screws 4 and 5. Therefore, electrical connection of the antenna circuit provided on the circuit board 3 to the feed portions 21*a* and 21*b* of the antenna radiating conductor 21 can be easily and reliably performed. Further, since the terminal members 9 and 10 are solder-joined to the feed portions 21*a* and 21*b*, there is no possibility of insufficient attachment strength of the on-vehicle electronic device 1 with respect to the glass surface 20. Furthermore, the circuit board 3 can be easily detached from the attachment base 2 by releasing the fastening of the attachment screws 4 and 5, while the required attachment strength can be secured by fastening the attachment screws 4 and 5 when attaching the circuit board 3 again to the attachment base 2. Accordingly, there is an advantage in that maintenance such as adjustment, repair, or component replacement of the antenna circuit can be easily performed.

Furthermore, in the present on-vehicle electronic device 1, the board mounting portions 9*b* and 10*b* of the terminal members 9 and 10 extend at the respective positions apart from the glass surface 20. Further, the attachment screws 4 and 5 are fastened to the board mounting portions 9*b* and 10*b*, respectively, so that the board mounting portions 9*b* and 10*b* are pressure-contacted with the feeding electrode 11 and the earth electrode 12. Therefore, even if the attachment screws 4 and 5 are inserted through the through holes 13 and 14 and screwed deep into the screw holes 9*d* and 10*d* after the corners of the circuit board 3 have been mounted on the board mounting portions 9*b* and 10*b*, the leading ends of the attachment screws 4 and 5 will not reach the glass surface 20. Accordingly, it is easy to perform an attachment operation of making the circuit board 3 pressure-contacted with and fixed to the terminal members 9 and 10 by using the attachment screws 4 and 5, and to increase the attachment strength of the circuit board 3 with respect to the terminal members 9 and 10.

The invention claimed is:

1. An on-vehicle electronic device comprising:

a circuit board including an antenna circuit, and a feeding electrode and an earth electrode drawn from the antenna circuit, wherein the feeding electrode and earth electrode are both formed on one surface of the circuit board;

an attachment base including a pair of terminal members comprising metal plates, wherein the attachment base is held by an insulative member and fixed to a glass surface of a vehicle window; and a plurality of attachment screws for attachably and detachably fixing the circuit board to the attachment base, wherein the circuit board is fixed to the attachment base, with the pair of the terminal members connected to a pair of feed portions of an antenna radiating conductor fixedly provided to the glass surface, and with the feeding electrode directly pressure-contacted with one of the two terminal members and the earth electrode directly pressure-contacted with the other one of the two terminal members.

2. The on-vehicle electronic device according to claim 1, wherein the antenna circuit includes a preamplifier circuit.

3. The on-vehicle electronic device according to claim 2, further comprising:

a shield case formed by a metal plate and attached to the circuit board to cover the preamplifier circuit, wherein one end of a coaxial cable held by the shield case is connected to a wiring pattern of the circuit board to establish conduction between the preamplifier circuit and an external circuit.

4. The on-vehicle electronic device according to claim 3, further comprising:

a radome formed of a synthetic resin and attached to the attachment base to cover the circuit board and the shield case.

5. An on-vehicle electronic device comprising:

a circuit board including an antenna circuit, and a feeding electrode and an earth electrode drawn from the antenna circuit;

an attachment base including a pair of terminal members held by an insulative member, and fixed to a glass surface of a vehicle window; and a plurality of attachment screws for attachably and detachably fixing the circuit board to the attachment base, wherein the circuit board is fixed to the attachment base, with the pair of the terminal members connected to a pair of feed portions of an antenna radiating conductor fixedly provided to the glass surface, and with the feeding electrode pressure-contacted with one of the two terminal members and the earth electrode pressure-contacted with the other one of the two terminal members, wherein the circuit board is formed with the feeding electrode and the earth electrode on a surface thereof, and includes a pair of through holes, which face the vicinities of the feeding electrode and the earth electrode, respectively, and through which the attachment screws are inserted, and wherein each of the terminal members includes a board mounting portion pres sure-contacted with either one of the feeding electrode and the earth electrode and formed with a screw hole into which the corresponding attachment screw is screwed.

6. The on-vehicle electronic device according to claim 5, wherein each of the terminal members is formed by a metal plate, which is bent between the board mounting portion and a fixed portion connected to the corresponding feed portion, and wherein a part of the metal plate is buried in the insulative member through insert molding.

* * * * *